US007346301B2

(12) United States Patent
Hashimoto et al.

(10) Patent No.: US 7,346,301 B2
(45) Date of Patent: Mar. 18, 2008

(54) IMAGE FORMING APPARATUS WITH A DEVELOPER REGULATING MEMBER

(75) Inventors: Kazunori Hashimoto, Numazu (JP); Takayuki Kanazawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 140 days.

(21) Appl. No.: 11/352,237

(22) Filed: Feb. 13, 2006

(65) Prior Publication Data

US 2007/0177907 A1 Aug. 2, 2007

(30) Foreign Application Priority Data

Jan. 30, 2006 (JP) ..... 2006-020974

(51) Int. Cl.
*G03G 15/08* (2006.01)

(52) U.S. Cl. ..... 399/284; 399/285

(58) Field of Classification Search ..... 399/284, 399/285, 55, 53

See application file for complete search history.

(56) References Cited

U.S. PATENT DOCUMENTS 4,499,169 A * 2/1985 Haneda et al. ..... 430/122.52
5,255,057 A * 10/1993 Stelter et al. ..... 399/285
5,519,472 A 5/1996 Ojima et al. ..... 399/274
6,125,246 A 9/2000 Hashimoto ..... 399/50
6,163,670 A 12/2000 Gomi et al. ..... 399/175
2001/0055503 A1* 12/2001 Kin et al. ..... 399/284
2002/0127033 A1* 9/2002 Inoue et al. ..... 399/279

FOREIGN PATENT DOCUMENTS

JP 9-127771 5/1997

* cited by examiner

*Primary Examiner*—Sophia S. Chen
(74) *Attorney, Agent, or Firm*—Fitzpatrick, Cella, Harper & Scinto

(57) ABSTRACT

The invention realizes a uniform toner coating on a developing roller, thereby preventing a density unevenness and a toner dripping and suppressing a developing roller set mark image in a contact developing method, by conditions that the DC voltage applied to the developer regulating member is the same as the DC voltage applied to the developer carrying member or at a side of a charging polarity of the developer with respect to the DC voltage applied to the developer carrying member; and a frequency f (Hz) and a peak electric field strength E (V/m) of the AC electric field formed by the AC voltage between the developer regulating member and the developer carrying member, and a peripheral speed v (m/s) of the image bearing member satisfy conditions:

$4.2\times v \leqq f \leqq 2500$ and $2.2\times 10^6 \leqq E \leqq 5.2\times 10^6$.

6 Claims, 3 Drawing Sheets

IMAGE FORMING APPARATUS WITH A DEVELOPER REGULATING MEMBER

BACKGROUND OF THE INVENTION

1. Field of the Invention

The present invention relates to an image forming apparatus for visualizing an electrostatic image, formed on an image bearing member for example by an electrostatic recording method, with a developer thereby obtaining a visible image. The image forming apparatus includes, for example, a copying machine, a printer (such as an LED printer or a laser beam printer), a facsimile apparatus, and a work processor.

2. Related Background Art

In an image forming apparatus of an electrophotographic method, an image bearing member such as an electrophotographic photosensitive member is charged and then exposed to light according to image information, whereby an electrostatic image is formed. Such electrostatic image is formed, by the supply of a developer to the image bearing member by developing means, into a developer image. Then such developer image is transferred by transfer means such as a transfer charger onto a recording material such as a recording paper, an OHP sheet or a cloth, and is fixed to the recording material by a fixing device to obtain a recorded image.

For example, an image forming apparatus, utilizing a contact charging apparatus as the charging means for charging the image bearing member, and a non-magnetic one-component contact developing apparatus as the developing means, is already known. A contact developing method employed in such contact developing apparatus is different from so-called jumping developing method in which a gap is formed between the image bearing member and a developer carrying member and an alternating electric field is applied therebetween to execute a development by causing a toner to fly across such gap, and executes a development by contacting the image bearing member with the developer carrying member. This method is becoming practiced recently because of advantages, generating little scattering of the developer at the developing step and capable of forming a developer image faithfully to the electrostatic image on the image bearing member.

FIG. 3 illustrates an example of such image forming apparatus Y. The image forming apparatus Y is constructed as a laser beam printer, and is equipped with a drum-shaped electrophotographic photosensitive member 1 (hereinafter called "photosensitive drum") as an image bearing member. The surface of the photosensitive drum 1 is uniformly charged by applying a predetermined charging bias to a charging roller 10, serving as a contact charger and contacted with and rotated by the photosensitive drum 1.

Then the surface of the photosensitive drum 1 is exposed, by an exposure apparatus 7 such as a laser beam scanner, to a light L corresponding to an image information signal, whereby an electrostatic latent image is formed. The electrostatic latent image formed on the photosensitive drum 1 is then rendered visible as a toner image, by the supply of a toner as a developer by a developing apparatus A. The toner is for example constituted of spherical toner particles excellent in a transfer property.

The developing apparatus A is equipped, in a developing container B, with a developer roller 2 constituting a roller-shaped developer carrying member, a developing blade 5 constituting a blade-shaped developer regulating member, and a toner supplying roller 3 constituting a developer supplying member. A toner contained in the developing container B is supplied, along with a rotation of the toner supplying roller 3 in a direction as indicated by an arrow, onto the surface of the developing roller 2. The toner on the developing roller 2 is supplied, along with the rotation of the developing roller 2 as indicated by an arrow, to a contact portion between the developing blade 5 and the developing roller 2, then given a triboelectric charge in this portion, and made into a thin layer of an appropriate amount. In this manner the developing blade 5 regulates a thickness of a toner layer carried on the developing roller. The toner made into a thin layer is further supplied, along with the rotation of the developing roller, to a contact portion with the photosensitive drum 1, thereby executing a development according to the electrostatic latent image.

On the other hand, a recording material P is supplied from a recording material cassette 18, through conveying means, to a transfer portion in which a transfer roller 11 is provided.

The toner image on the photosensitive drum 1 is transferred, under an application of a transfer bias (voltage) to the transfer roller 11, onto the recording material P, thereby forming an unfixed image thereon. Then the recording material P is conveyed to a fixing apparatus 6, which fixes the unfixed image to the recording material P, and is further conveyed to a sheet discharge tray 25, whereby the image formation is completed.

Also a transfer residual toner, remaining on the photosensitive drum 1 without being transferred onto the recording material P at the image transfer, is recovered by a cleaning blade 8, constituting cleaning means, into a waste toner container 9. Thus the surface of the photosensitive drum 1 is cleaned and is used again for image formation.

As explained above, the toner in the developing apparatus A is subjected, on the developing roller 2, to a friction with the toner supplying roller 3 and the developing blade 5, and also subjected, at the developing operation, to a friction with the photosensitive drum 1. The toner, after such repeated frictional actions, assumes a state different from a new toner. More specifically, an additive such as silica, externally added to the surface of the toner particle, may be embedded into the toner particle itself or may be liberated therefrom. Therefore the toner shows a gradual change in properties required for the developer, such as fluidity and a charging property. Such phenomenon of changes in the physical properties of the toner becomes eminent when the image forming operation is repeated many times.

According to the studies undertaken by the present inventors, the toner with such change in the physical properties (hereinafter called "deteriorated toner") causes, when mixed with a toner with a lower level of deterioration in the developing apparatus, induces an agglomeration of both toner particles because of the deterioration in the charging property, fluidity and the like. Also such agglomeration may result in density unevenness in an image and a toner dripping (an agglomerated toner block dripping onto an image in spot-like manner).

For avoiding such density unevenness or toner dripping, there can be conceived a method of reducing a frictional load on the toner, or a method of rendering the toner particle itself resistant to the property changes. However, the former method involves a basic construction such as a triboelectric charging by the developing blade or a contact with the developing drum, so that the extent of reduction in the frictional load has to be limited. Also the latter method is inevitably limited in consideration of assuring necessary properties for the toner, such as fluidity, triboelectric chargeability and fixing property.

In consideration of such situation, other solutions are being desired for such density unevenness and toner dripping, and for example Japanese Patent Application Laid-open No. H09-127771 proposes, in a developing apparatus, to form an alternating electric field between the developing roller and the developing blade. This developing apparatus causes a reciprocating motion of the toner between the developing roller and the developing blade to disintegrate the agglomerated toner thereby preventing the density unevenness and the toner dripping and stabilizing the toner coating on the developing roller.

Also U.S. Pat. No. 5,519,472 proposes, in a developing apparatus, to form an alternating electric field between the developing roller and the developing blade, thereby preventing an uneven charging of the toner and an uneven coating of the toner on the developing roller.

In the contact developing method, however, an alternating electric field formed within the range as described in Japanese Patent Application Laid-open No. H09-127771 between the developing roller and the developing blade may be unable to avoid the toner dripping or the density unevenness with a toner in a state with changed physical properties after repeated image forming operations. Also with the alternating electric field formed within the range as described in U.S. Pat. No. 5,519,472 between the developing roller and the developing blade, the toner coating state on the developing roller may still show a fluctuation, thus resulting in a decreased toner amount on the developing roller and giving a low density. Also when the image forming operation is repeated many times, the toner may sticks to the developing blade, thereby resulting in a longitudinally streaked image, called a development streak.

Also in the contact development method, when the developing apparatus is left standing for a prolonged period, the developing roller may become locally recessed, in a contact position between the developing roller and the developing blade, by a pressure of the developing blade, whereby a toner coating amount on the developing roller may become increased in such recessed portion, thus giving rise to a banding image in which the image density becomes higher at a cycle of the peripheral length of the developing roller (such image being hereinafter called "developing roller set mark image").

SUMMARY OF THE INVENTION

An object of the present invention is to provide an image forming apparatus capable of obtaining a uniform coated state of a developer on a developer carrying member.

Another object of the present invention is to provide an image forming apparatus capable of suppressing density unevenness in the image.

Still another object of the present invention is to provide an image forming apparatus capable of preventing a dripping of the developer in agglomerated blocks.

Still another object of the present invention is to provide an image forming apparatus capable of preventing generation of a set mark image of the developer carrying member.

Still another object of the present invention is to provide an image forming apparatus adapted for a contact development method.

Still other objects of the present invention, and features thereof, will become fully apparent from the following detailed description, which is to be taken in conjunction with the accompanying drawings.

DETAILED DESCRIPTION OF THE PREFERRED EMBODIMENTS

In the following, there will be explained, in detail, preferred embodiments for executing the present invention, with reference to drawings and examples. However, in the examples, dimensions, materials, shapes, relative positions and the like of constituent components are not to be construed to restrict the present invention to such description, unless particularly specified otherwise. Also a material, a shape and the like of a member, once explained in the description, are assumed to be similar throughout the text, unless specifically described otherwise again.

Figure 1:
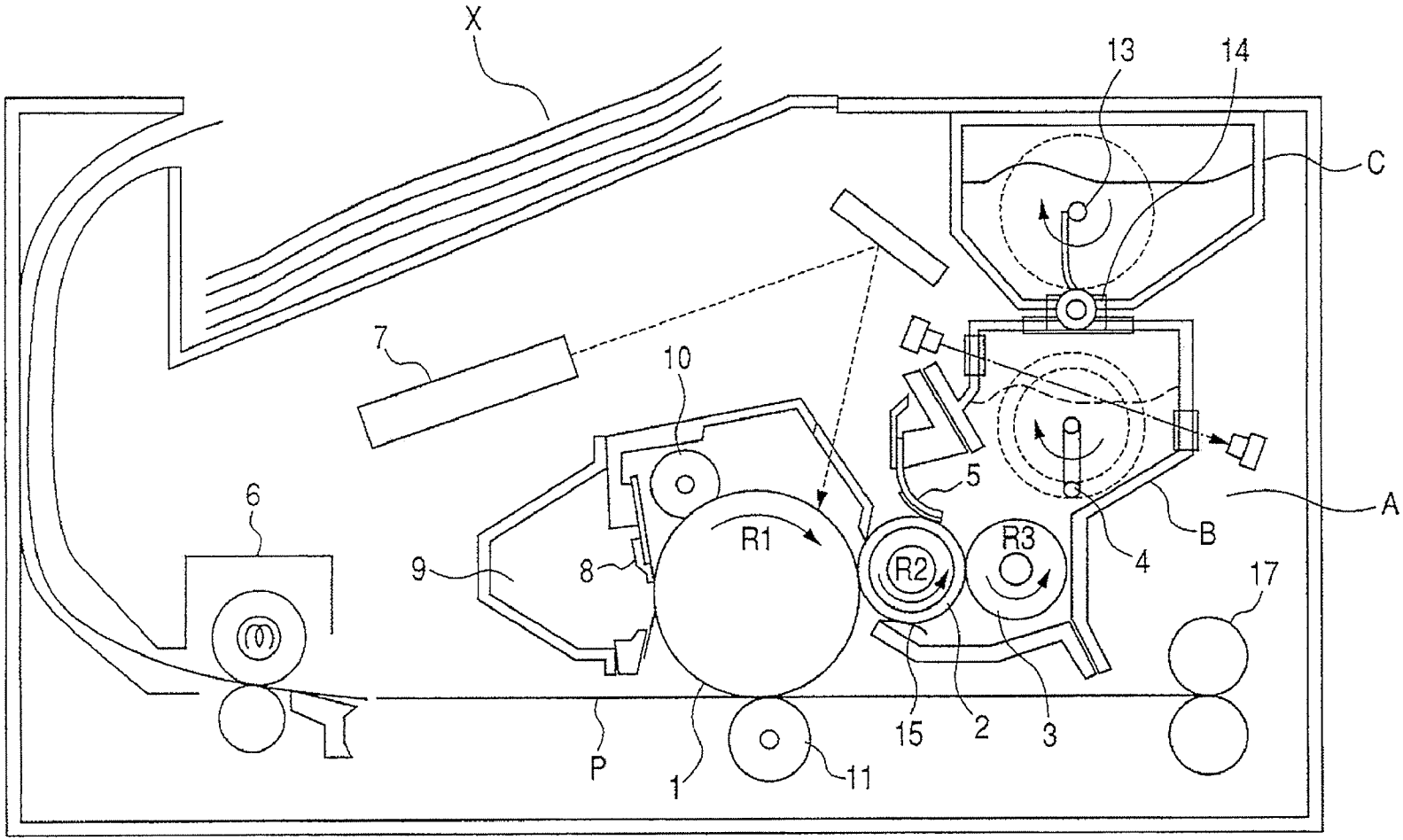
FIG. 1 is a view showing an image forming apparatus embodying the present invention.

FIG. 1 is a schematic cross-sectional view showing an image forming apparatus embodying the present invention. The present embodiment explains a monochromatic image forming apparatus for forming an image of black color only, but the present invention is not limited to such embodiment and is likewise applicable to a color image forming apparatus for an image formation of plural colors. Also a member having an equivalent function to that in a conventional art will be represented by a same symbol as that in the conventional art.

An image forming apparatus of the present embodiment is provided with an image bearing member which is a drum-shaped electrophotographic photosensitive member for forming an electrostatic latent image (the member being hereinafter called "photosensitive drum"), and a developing apparatus for developing the electrostatic latent image with a developer. There are further provided developer supplying means for supplying the developing apparatus with the developer (hereinafter called "toner hopper"), and control means for controlling the supply of the developer from the developer supplying means.

The image forming apparatus X is provided, at an approximate center thereof, a drum-shaped electrophotographic photosensitive member, namely a photosensitive drum 1, supported rotatably in a direction indicated by the arrow R1. When an image forming operation is initiated, a charging roller 10 serving as charging means uniformly charges the surface of the photosensitive drum 1. Thereafter a laser irradiating means 7 serving as exposure means exposes the surface of the photosensitive drum 1 with a laser light corresponding to image information, thereby forming an electrostatic latent image on the photosensitive drum 1.

In the present embodiment, the photosensitive drum 1 is negatively chargeable. The electrostatic latent image corresponding to the image information is formed in a portion where a negative charge is attenuated by the exposure to the laser light from the laser irradiating means 7.

Along with a subsequent rotation of the photosensitive drum 1, the electrostatic latent image is rendered visible by a toner, supplied as the developer from the developing apparatus A, whereby a toner image is formed on the photosensitive drum 1.

The present embodiment adopts a reversal development method. Therefore, a toner of a charge polarity (negative polarity) same as the charging polarity of the photosensitive drum is deposited in an area (image area) on the photosensitive drum 1, where the negative charge is attenuated. Also the toner is replenished from a toner hopper C serving as developer containing means to a developing container B of the developing apparatus.

On the other hand, a recording material P, contained in an unillustrated cassette, is conveyed by a sheet feeding roller 17 to a transfer area where the photosensitive drum 1 is contacted with a transfer roller 11 serving as transfer means, in synchronization with the arrival of the toner image on the photosensitive drum 1 at the transfer area.

When the toner image on the photosensitive drum 1 and the recording material P reach the transfer area, the toner image is transferred onto the recording material P by a transfer electric field formed by the transfer roller 11 in the transfer area. Thereafter, an unfixed toner image borne on the recording material P is subjected to a heating by fixing means (heat roller) and a pressure by pressurizing means, both provided in a fixing apparatus 6, thereby being fixed as a permanent image on the recording material P.

Also after the toner image transfer, the surface of the photosensitive drum 1 is subjected to a removal of a transfer residual toner remaining thereon, by a cleaning apparatus 8 provided with a blade-shaped cleaning means, thereby being prepared for a next image forming operation.

Figure 2:
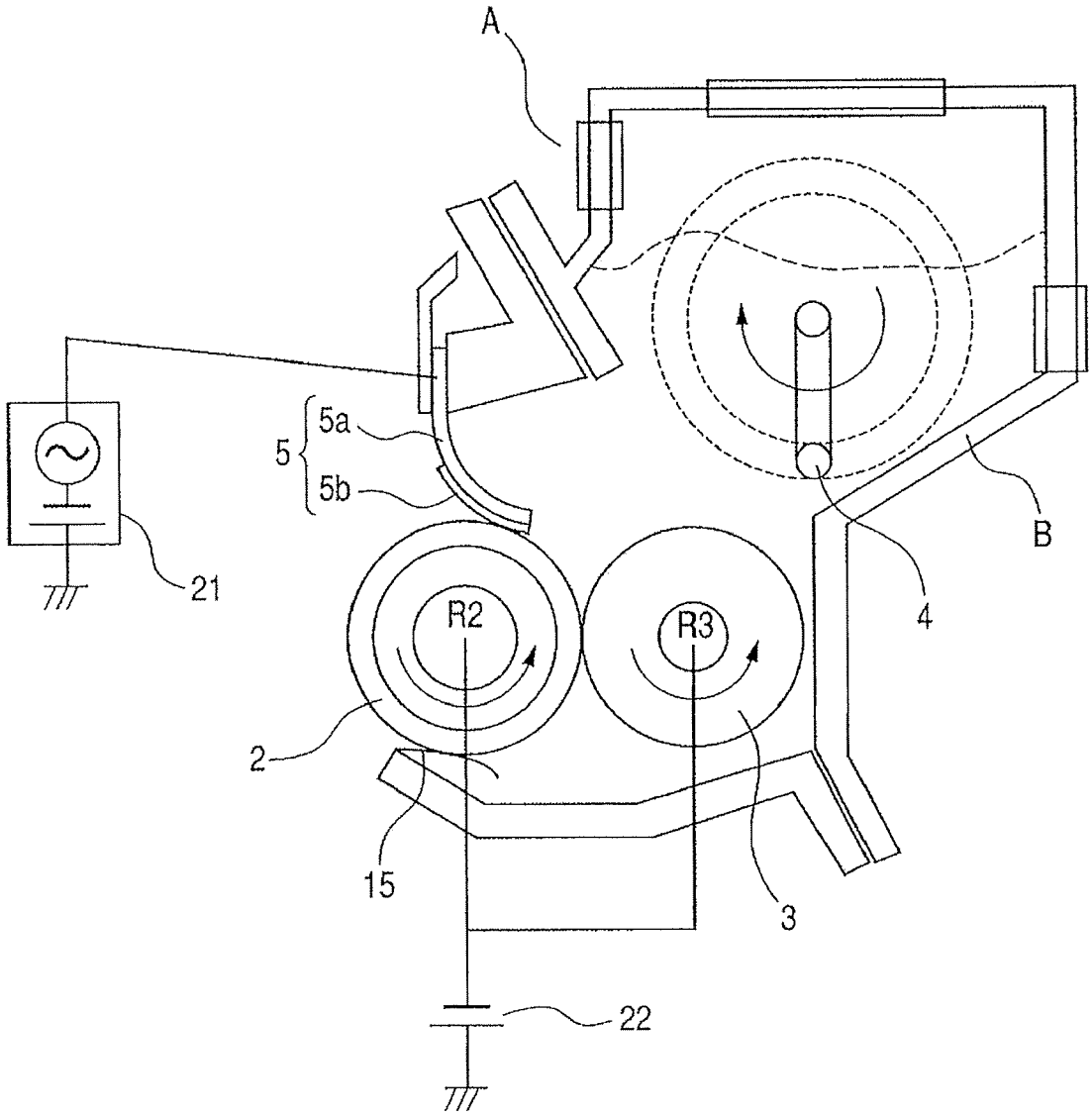
FIG. 2 is a view showing a developing apparatus shown in FIG. 1.
Figure 3:
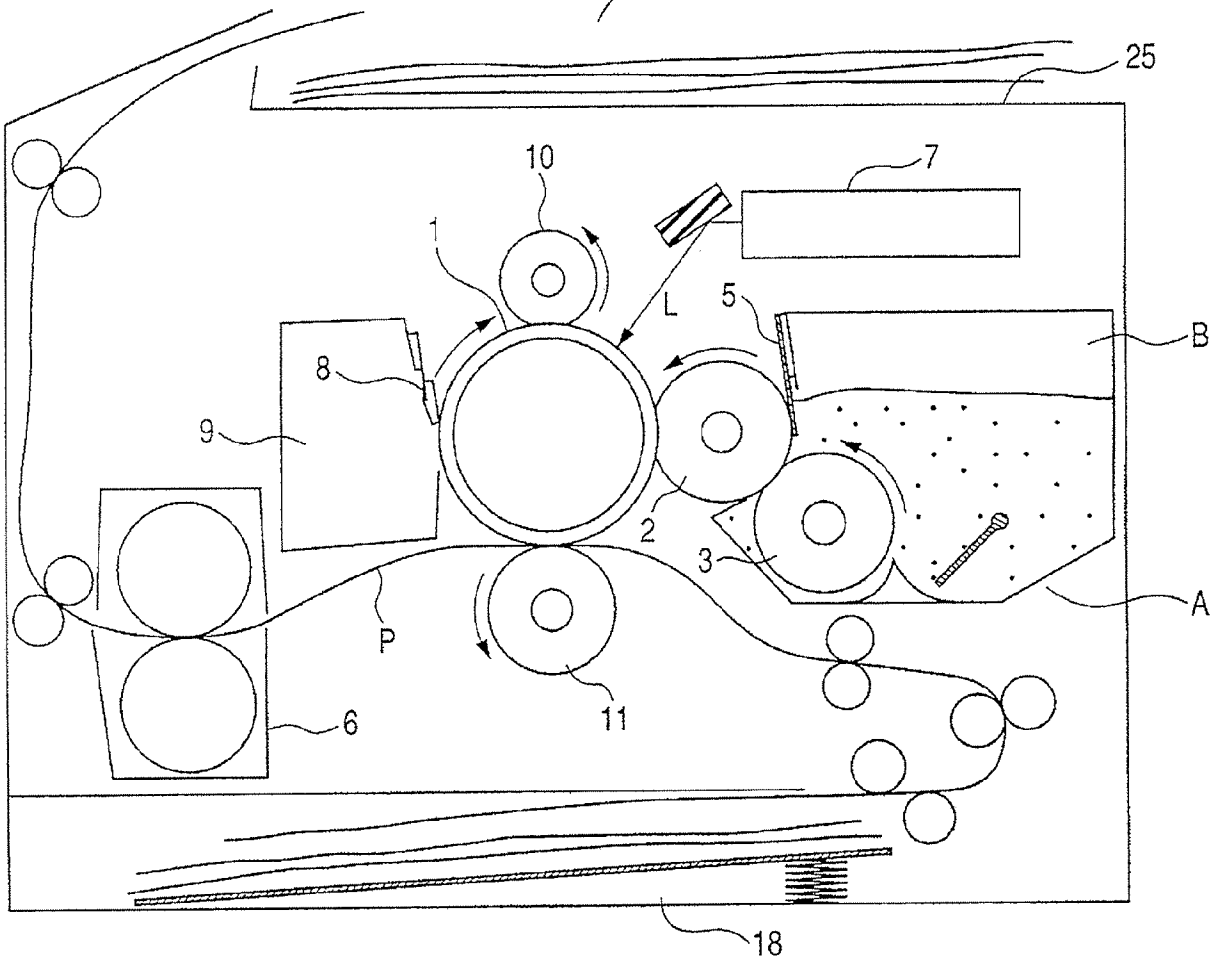
PRIOR ART FIG. 3
FIG. 3 is a view showing an example of a conventional art.

In the following, explanations will be given on the developing apparatus A and the toner hopper C. FIG. 2 is a partial cross-sectional view showing a schematic configuration of the developing apparatus A of the present embodiment.

The developing apparatus A employs a contact developing method of contacting a developer carrying member with an image bearing member, and executing a development in a "contact" state of the developer with the image bearing member.

In the present embodiment, the developing apparatus A is equipped with a developer carrying member (hereinafter called "developing roller") 2 for carrying the developer and contacting the developer with the image bearing member thereby developing the electrostatic latent image. The developing apparatus A is further equipped with a developer regulating member (hereinafter called "developing blade") 5 for regulating a thickness of the developer thereby forming a thin layer of the developer on the developer carrying member, and also with developer supplying means (hereinafter called "toner supplying roller") 3 for supplying the developer carrying member with the developer.

In the toner hopper C, as shown in FIG. 1, there are provided an agitating member 13 for disintegrating the toner in the toner hopper C, and a replenishing roller 14 for replenishing the toner from the toner hopper C to the developing apparatus A. The replenishing roller 14, under a replenishing instruction from control means, replenishes the toner of a predetermined amount to the developing container B.

The developer employed in the present embodiment is a negatively chargeable non-magnetic one-component developer (toner). More specifically, the toner has a structure including therein a substance of a low softening point, thereby achieving an energy saving in the fixing apparatus. Such toner can be prepared by a developer producing method by a suspension polymerization, as described for example in Japanese Patent Publication No. S63-10231, Japanese Patent Application Laid-open Nos. S59-53856 and S59-61842.

Particularly in a contact developing method utilizing a non-magnetic one-component developer as in the present embodiment and utilizing a system of replenishing the developer into the developing apparatus, when a deteriorated toner in the developing apparatus is mixed with a non-deteriorated new toner, both toners tend to cause an agglomeration, and such agglomeration may induce a density unevenness on the image or a toner dripping (toner blocks dripping in spots onto the image).

The toner is constituted of spherical toner particles of a volume-average particle diameter of 6 μm. Such toner has so-called core/shell internal structure formed by covering a substance of a low softening point with a shell resin, in which the shell portion is formed by a polymerization method.

A suspension polymerization under a normal temperature or under an increased pressure allows to relatively easily obtain spherical particles of a particle diameter of 3-8 μm with a sharp particle size distribution. Such particles have a sharp charge-to-weight ratio distribution and can achieve a uniform development corresponding to a developing contrast.

The toner may also be produced, in addition to the suspension polymerization, by a dispersion polymerization for directly forming the toner utilizing an aqueous organic solvent in which a monomer is soluble but an obtained polymer is insoluble. The toner may further be produced by an emulsion polymerization, represented by a soap-free polymerization, in which the toner is produced by a direct polymerization in the presence of a water-soluble polar polymerization initiator.

The toner, employed as the developer in the present embodiment, has a mean degree of circularity of 0.950 or higher, thereby significantly improving a fogging property and a transfer property. This is because the toner particle has a small contact area with the photosensitive member due to the very high circularity, whereby the toner particle shows a lowered adhesion force to the photosensitive member, resulting from a mirror force or a van der Waals' force, and is therefore easily transferred. Another reason resides in a fact that the triboelectric charging between the triboelectric charging member and the individual toner particles takes place uniformly, thereby reducing a fluctuation in the charge amount, leading to a fog or deterioration in the image quality. The mean degree of circularity of the toner is preferably made 0.970 or higher, because the above-mentioned effects are more enhanced. In the following, a method for measuring the mean degree of circularity in the present invention will be explained.

In the present embodiment, the mean degree of circularity is employed as a convenient method for quantitatively representing a particulate shape. In the present embodiment, the measurement was executed with a flow-type particle image analyzing apparatus FPIA-1000, manufactured by Toa Medical Electronic Co. A circularity (Ci) of each particle, in a group of particles having a circle-corresponding diameter of 3 μm or larger, is determined by a following equation (1)-1, and a mean degree of circularity (Cmean) is defined, as indicated in an equation (1)-2, by dividing a total sum of the degrees of circularities of all the measured particles with a number (m) of all the particles:

degree of circularity (Ci)=(circumferential length of a circle having a projection area same as the particle)/(circumferential length of a projection image of a particle) (1)-1

$$\text{mean degree of circularity } Cmean = \sum_{i=1}^{m} Ci/m \quad (1)\text{-}2$$

The measuring apparatus FPIA-1000 employed in the present embodiment calculates, after measuring the circularity of each particle, a mean degree of circularity and a mode circularity. The mean degree of circularity and the mode circularity are calculated by a method of dividing the particles, according to the circularity thereof, into 61 classes divided within a range of degree of circularity of 0.40-1.00, and calculating the mean degree of circularity by a center value of each division and a frequency.

More specifically, the measurement is executed by dispersing about 5 mg of the developer in 10 ml of water containing a surfactant by about 0.1 mg to obtain a dispersion liquid, then irradiating the dispersion liquid with an ultrasonic wave (20 kHz, 50 W) for 5 minutes, and executing the measurement with the aforementioned apparatus with a concentration of the dispersion at 5,000-20,000 particle/μl to obtain a mean degree of circularity of a particle group having a circle-corresponding diameter of 3 μm or larger.

The mean degree of circularity in the present embodiment is an index for surface irregularities of the developer particle, and becomes 1.000 for a completely spherical developer particle or becomes smaller as the developer particles have more complex surface shape.

In the present embodiment, the circularity is measured only on particles having a circle-corresponding diameter of 3 μm or larger, because the particles of a circle-corresponding diameter less than 3 μm contain particles of an extraneous additive, present independently from the toner particles, and because such independently present particles of the extraneous additive will perturb an exact estimation of the degree of circularity of the toner particles.

In the following, members provided in the developing apparatus A will be explained.

The developing apparatus A contains toner in a developing container B. The developing container B is provided with a developing chamber containing a developing roller 2, a toner supplying roller 3 and a developing blade 5, an agitating chamber in which an agitating member 4 is provided, and an aperture for toner transfer from the agitating chamber to the developing chamber. The agitating chamber is positioned above the developing chamber, across the aperture.

The developing container B is also provided with an aperture in a part of a side thereof opposed to the photosensitive drum 1. The developing roller 2 is supported in the developing container B so as to be partially exposed from the aperture and rotatable in a direction indicated by the arrow R2. The developing roller 2 has an elastic layer and is contacted with the photosensitive drum 1 under a predetermined contact pressure. The aperture is equipped with a blow-out preventing sheet 15, for preventing a toner scattering from below the developing roller 2.

The developing roller 2 is a semiconductive elastic roller, formed by a low-hardness rubber material (such as silicone or urethane resin) in which an electroconductive material (such as carbon) is dispersed, a foamed material or a combination thereof.

In a lower part-of the agitating area, a toner supplying roller 3 for toner supply and toner recovery is provided in contact with the developing roller 2. The toner supplying roller 3 is an elastic roller formed by an elastic foamed member, and is rotated in a direction indicated by the arrow R3 at a contact point with the developing roller 2.

The toner is sufficiently agitated by the agitating member 4 in the agitating area, then passes the aperture by a principally gravitational movement, then carried by the toner supplying roller 3 and supplied to the developing roller 2.

In the developing apparatus A, a developing blade 5 is provided as a developer regulating member for regulating the toner layer thickness on the developing roller 2, so as to pressurize the developing roller 2. The developing blade 5 has a plate-like shape, and includes an insulation layer 5*b* constituting an insulating portion at the side of the developing roller, and an electroconductive layer 5*a* constituting an electroconductive portion positioned opposite to the developing roller with respect to the insulation layer 5*b*.

The developing blade 5 is formed by an elastic regulating member, constituted of a conductive layer 5*a* of an elastic thin metal plate of a thickness of 0.1 mm and an insulation layer 5*b* of a total thickness of 0.1 mm formed by an insulation layer of a thickness of 75 μm and an adhesive layer of a thickness of 25 μm, and provided at a side to be contacted with the developing roller 2. The conductive layer 5*a* of the developing blade 5 is given, by a power source 21, an AC voltage superimposed with a DC voltage (blade AC bias). In the developing blade 5 of the present embodiment, the conductive layer 5*a* is formed by a thin phosphor bronze plate, but it may also be formed by a metal thin plate of stainless steel or aluminum. Also the insulating layer 5*b* is formed by a thin film of a polyamide elastomer, but it may also be formed by a thin film of urethane rubber or urethane resin. The insulation layer 5*b* is naturally required to have at least a certain resistance for avoiding a leakage between the developing roller 2 and the conductive layer 5*a*, and preferably has a volume resistivity of $10^{10}$ Ω·cm or higher.

The toner supplied by the toner supplying roller 3 onto the developing roller 2 is regulated in thickness by the developing blade 5 and coated on the developing roller 2 thereby forming a thin toner layer. In this operation, a friction with the surfaces of the developing roller 2 and the developing blade 5 provides the toner with a charge sufficient for the developing operation.

Thereafter, the thin toner layer on the developing roller 2 is carried, by the rotation of the developing roller 2, to a developing area (developing nip) where the photosensitive drum 1 and the developing roller 2 are in mutual contact, and the toner is subjected to a development in a state in contact with the photosensitive drum 1. A power source 22 is connected in order to form a developing electric field between the photosensitive drum 1 and the developing roller 2. As a result, under the function of such developing electric field, the toner on the developing roller 2 is transferred onto the photosensitive drum 1 and forms a toner image corresponding to the electrostatic latent image thereon, thus rendering the electrostatic latent image visible.

Also the toner, which is coated on the developing roller 2 and carried to the developing nip but does not contribute in the development thereby remaining carried on the developing roller 2, is scraped off from the developing roller 2 by a friction with the toner supplying roller 3. Then a part of thus scraped toner is supplied again by the toner supplying roller 3, together with a toner newly supplied by the toner supplying roller 3, onto the developing roller 2, and a remainder is returned into the developing container B.

In the present embodiment, the toner supplying roller 3 has two functions of developer supply and developer recovery, but the present invention is not limited to such embodiment and it is possible to provide developer supplying means and developer recovering means independently.

The image forming apparatus X of the present embodiment has a process speed (peripheral speed of the photosensitive drum 1) of 190 mm/sec, and the developing roller 2 has a peripheral speed of 295 mm/sec.

The developing apparatus A is constructed detachably from the image forming apparatus X, and is replaced after a predetermined service life.

In the following, there will be explained a method of application and an effect of an alternating electric field formed in the present embodiment between the developing roller 2 and the developing blade 5.

At a developing operation, the developing roller 2 is connected to a power source 22 capable of applying a DC voltage without an AC voltage, and the developing blade 5 is connected to a power source 21 capable of applying a superimposed voltage of an AC voltage and a DC voltage. The power source 22 supplies the developing roller 2 with a developing bias voltage of a DC component of −300 V, thereby enabling the negatively charged toner to develop a latent image having a potential of −100 V in an exposed area of the photosensitive drum 1 (non-exposed area having a potential of −600 V).

The power source 21 supplies the developing blade 5, as a blade bias to be supplied to the conductive layer 5*a* of the developing blade 5, with a voltage including a DC component of −300 V same as the developing bias, and an AC component of a sinusoidal voltage having a peak-to-peak voltage of 600 V and a frequency of 1500 Hz.

By setting such developing bias and blade bias, an AC electric field is formed between the developing roller 2 and the developing blade 5. Thus, the toner, entering the contact nip portion of the developing roller 2 and the developing blade 5, is subjected, in the vicinity of entrance of the nip, to a power of the alternating electric field. It is thus estimated that the toner as a result initiates a reciprocating motion between the developing roller 2 and the developing blade 5, whereby the agglomerated toner is disintegrated in such area and is regulated by the developing blade 5 in a constantly stable state thereby forming a thin toner layer on the developing roller 2.

It is thus rendered possible to prevent density unevenness and a toner dripping, which tend to appear after repeated image forming operations.

Also as a result of studies undertaken by the present inventors, it is found that an alternating electric field between the developing roller 2 and the developing blade 5 is effective for preventing a developing roller set mark image. The developing roller set mark image means a banding in image appearing at a cycle corresponding to the peripheral length of the developing roller, generated when the developing apparatus A is left standing for a long period and the developing roller 2 is recessed by the pressure of the developing blade 5.

More specifically, it is found that an alternating electric field exceeding a certain value between the developing roller 2 and the developing blade 5 can prevent the toner amount, carried in a recessed portion on the developing roller 2, from becoming larger than in other portions. This is presumably because the alternating electric field provides a stronger influence on the toner amount entering the contact nip portion between the developing roller 2 and the developing blade 5, thereby increasing the toner regulation in the recessed portion, in comparison with a case without the alternating electric field.

As a result, the developing roller set mark image becomes no longer visible by setting the alternating electric field between the developing roller 2 and the developing blade 5 at or above a predetermined value.

Also in the present embodiment, a same DC component is applied to the developing roller 2 and the conductive layer 5*a*. It is thus possible to prevent the toner, which is basically negatively charge and has an opposite polarity in a very limited part, from being deviated to either of the developing roller 2 and the developing blade 5, thereby further enhancing the disintegrating effect on the toner. It is also possible to avoid a fusion bonding of the toner to the developing roller or the developing blade by a prolonged deposition thereon, thereby preventing a fog caused by a fusion bonding of the toner on the developing roller or a longitudinally streaked image caused by a fusion bonding of the toner on the developing blade. Thus, even in a printing operation over a prolonged period, the toner and the external additive thereof can be suppressed from being fusion bonded to the developing blade. Therefore, a same DC component applied to the developing roller and the developing blade allows to execute a stable toner coating on the developing roller.

On the other hand, a change in the blade bias applied to the developing blade 5 was tried. More specifically, an investigation was conducted by employing, a blade bias applied to the conductive layer 5*a* of the developing blade 5, a voltage containing a DC component of −400 V which is lower by 100 V than the developing bias and an AC component of a sinusoidal wave of a peak-to-peak voltage of 600 V and a frequency of 1500 Hz. As a result, the toner fusion bonding to the developing roller 2 was slightly aggravated, but a fog or a streaked image was not observed. This is presumably because the fusion bonding of the toner and the extraneous additive to the developing roller 2 is reduced, as the developing roller 2 has a surface area considerably larger than a nip area in the contact portion of the developing blade 5 with the developing roller 2. In this manner, the DC voltage applied to the developing blade may be selected at the side of the charging polarity of the toner (namely negative side) than the DC voltage applied to the developing roller. In such case, it is possible, after a printing operation over a prolonged period, to prevent a fog or a streaked image though the fusion bonding of the toner or the external additive thereof to the developing roller increases slightly. Thus, a stable toner coating on the developing roller can be achieved also in this case.

As explained in the foregoing, formation of a strong alternating electric field equal to or higher than a predetermined value between the developing roller 2 and the developing blade 5 allows to prevent a density unevenness and a toner dripping, and also to suppress generation of a developing roller set mark image.

The present inventors have executed an experiment, in order to investigate an optimum range of the alternating electric field between the developing roller 2 and the developing blade 5 in the present embodiment. At first a toner dripping was evaluated. More specifically, in the developing apparatus A, the developing roller 2 was grounded, and the conductive layer 5*a* of the developing blade 5 was given a voltage containing a DC component of 0 V and a sinusoidal AC component with a peak-to-peak voltage and a frequency, in various levels. The developing roller was rotated in this state, and a state of toner dripping on the developing roller 2 after 10 hours was observed and evaluated. Also the developing blade 5 had an insulation layer 5*b* of three thicknesses of 0.04 mm, 0.1 mm, and 0.135 mm. The results of evaluation are summarized in Table 1.

TABLE 1

| insulation layer thickness (mm) | Vp − p (V) | electric field strength E (V/m) | frequency (Hz) 1000 | 1500 | 2000 | 2500 | 3000 |
|---|---|---|---|---|---|---|---|
| 0.04 | 100 | $1.3 \times 10^6$ | − | − | − | − | − |
| | 200 | $2.5 \times 10^6$ | + | + | + | + | − |
| | 400 | $5 \times 10^6$ | + | + | + | + | − |
| | 600 | $7.5 \times 10^6$ | − | − | − | − | − |
| | 800 | $1 \times 10^7$ | − | − | − | − | − |
| | 1000 | $1.3 \times 10^7$ | − | − | − | − | − |
| 0.1 | 200 | $1 \times 10^6$ | − | − | − | − | − |
| | 400 | $2 \times 10^6$ | + | + | + | + | − |
| | 600 | $3 \times 10^6$ | + | + | + | + | − |
| | 800 | $4 \times 10^6$ | + | + | + | + | − |
| | 1000 | $5 \times 10^6$ | + | + | + | + | − |
| | 1200 | $6 \times 10^6$ | − | − | − | − | − |
| | 1400 | $7 \times 10^6$ | − | − | − | − | − |
| 0.135 | 200 | $7.4 \times 10^5$ | − | − | − | − | − |
| | 400 | $1.5 \times 10^6$ | + | + | + | + | − |
| | 600 | $2.2 \times 10^6$ | + | + | + | + | − |
| | 800 | $3 \times 10^6$ | + | + | + | + | − |
| | 1000 | $3.7 \times 10^6$ | + | + | + | + | − |
| | 1200 | $4.4 \times 10^6$ | + | + | + | + | − |
| | 1400 | $5.2 \times 10^6$ | + | + | + | + | − |

In Table 1, (+) indicates no generation, and (−) indicates an evident generation. As shown in Table 1, the frequency was effective up to about 2500 Hz, but at a frequency of 3000 Hz, a toner scattering started from the end portion of the developing roller 2. Also as to the electric field strength, an alternating electric field has an effect for preventing the toner dripping, but a field less than $1.5\times10^6$ V/m only has a weak preventing effect and a toner dripping, though slightly, could be observed from an end portion of the developing roller 2. Also with an insulation layer of a thickness of 0.1 mm, a leak was developed when the electric field strength reached $6\times10^6$ V/m, whereby the toner coating on the developing roller 2 became unstable. As a potential difference caused by the alternating voltage between the developing roller and the developing blade is given by Vpp/2, the electric field strength is given by Vpp/2/(thickness of insulation layer).

It was thus determined that the optimum range of the alternating electric field E (V/m) against the toner dripping was:

$$1.5\times10^6 \leqq E \leqq 5.2\times10^6 \quad (2).$$

Also the range for the frequency f (Hz) was identified as:

$$f \leqq 2500 \quad (3).$$

Then an evaluation was made on the developing roller set mark image. More specifically, an output image was evaluated with the image forming apparatus X of the present embodiment, under a developing bias having a DC component of −300 V applied from the power source 22 to the developing roller 2, and a blade bias supplied from the power source 21 to the conductive layer 5*a* of the developing blade 5 and containing a DC component of −300 V and an AC component with a peak-to-peak voltage and a frequency in various levels. Also the developing blade 5 had an insulation layer 5*b* of three thicknesses of 0.04 mm, 0.1 mm, and 0.135 mm, as in the evaluation of toner dripping. The evaluation was made with a developing roller after the developing apparatus was left standing for 6 months, in order to execute the evaluation with a developing roller in a sufficiently recessed state. Results of evaluation are summarized in Table 2.

TABLE 2

| insulation layer thickness (mm) | Vp − p (V) | electric field strength E (V/m) | frequency (Hz) 1000 | 1500 | 2000 | 2500 |
|---|---|---|---|---|---|---|
| 0.04 | 100 | $1.3 \times 10^6$ | ± | ± | ± | ± |
| | 200 | $2.5 \times 10^6$ | + | + | + | + |
| | 400 | $5 \times 10^6$ | + | + | + | + |
| 0.1 | 200 | $1 \times 10^6$ | ± | ± | ± | ± |
| | 400 | $2 \times 10^6$ | ± | ± | ± | ± |
| | 600 | $3 \times 10^6$ | + | + | + | + |
| | 800 | $4 \times 10^6$ | + | + | + | + |
| | 1000 | $5 \times 10^6$ | + | + | + | + |
| 0.135 | 200 | $7.4 \times 10^5$ | ± | ± | ± | ± |
| | 400 | $1.5 \times 10^6$ | ± | ± | ± | ± |
| | 600 | $2.2 \times 10^6$ | +± | +± | +± | +± |
| | 800 | $3 \times 10^6$ | + | + | + | + |
| | 1000 | $3.7 \times 10^6$ | + | + | + | + |
| | 1200 | $4.4 \times 10^6$ | + | + | + | + |
| | 1400 | $5.2 \times 10^6$ | + | + | + | + |

In Table 2, (+) indicates no generation, (+±) indicates a very slight generation, and (±) indicates a slight generation. According to the results shown in Table 2, an electric field strength of $2.2\times10^6$ V/m or higher provided satisfactory results on the developing roller set mark.

Thus, an optimum range of the alternating electric field E for the developing roller set mark image was identified as:

$$2.2\times10^6 \leqq E \quad (4).$$

Also the alternating electric field requires a frequency of 800 Hz or higher, as a frequency of the alternating electric field equal to or less than 700 Hz generated lateral lines on the output image. The frequency of the alternating electric field, giving rise to lateral-lined image, is variable also depending on and is proportional to the peripheral speed of the photosensitive drum. In consideration of the peripheral speed of 190 mm/sec in the photosensitive drum 1 of the present embodiment, an appropriate range of the frequency f (Hz) not generating a lateral-lined image is defined by $800/(190\times10^{-3}) \leqq f/v$ wherein v (m/s) represents the peripheral speed of the photosensitive drum 1, namely:

$$4.2\times10^3 \times v \leqq f \quad (5).$$

In summary, an appropriate range of the electric field strength E (V/m) of the electric field to be formed between the developing roller 2 and the developing blade 5 is derived from the relations (2) and (4) as follows:

$$2.2\times10^6 \leqq E \leqq 5.2\times10^6$$

and an appropriate range of the frequency f (Hz) of the alternating electric field to be formed between the developing roller 2 and the developing blade 5 is derived from the relations (3) and (5) as follows:

$$4.2\times10^3 \times v \leqq f \leqq 2500.$$

It is thus possible, by forming an alternating electric field within the above-mentioned appropriate range between the developing roller 2 and the developing blade 5, to prevent the toner dripping and also to suppress the developing roller set mark image, generated after a prolonged standing.

Thus, the present invention forms an alternating electric field of a predetermined range between a developer carrying member and a developer regulating member to stabilize a developer coating on the developer carrying member thereby preventing an unevenness in the image density and a developer dripping, and also avoiding a set mark of the developer carrying member generated after a prolonged standing.

This application claims priority from Japanese Patent Application No. 2006-020974 filed Jan. 30, 2006, which is hereby incorporated by reference herein.

What is claimed is:

1. An image forming apparatus comprising:

an image bearing member;

a developer carrying member provided in contact with the image bearing member and serving to develop an electrostatic image formed on the image bearing member with a non-magnetic one-component developer, the developer carrying member being adapted to carry the developer; and a developer regulating member for regulating a thickness of a layer of the developer carried on the developer carrying member, wherein a DC voltage is applied to the developer carrying member, and a superimposed voltage formed by superimposing a DC voltage and an AC voltage is applied to the developer regulating member, the DC voltage applied to the developer regulating member is the same as the DC voltage applied to the developer carrying member or at a side of a charging polarity of the developer with respect to the DC voltage applied to the developer carrying member, and a frequency f (Hz) and a peak electric field strength E (V/m) of the AC electric field formed by the AC voltage between the developer regulating member and the developer carrying member, and a peripheral speed v (m/s) of the image bearing member satisfy conditions:

$$4.2\times v \leqq f \leqq 2500 \text{ and}$$

$$2.2\times 10^6 \leqq E \leqq 5.2\times 10^6.$$

2. An image forming apparatus according to claim 1, wherein the developer regulating member has a plate shape.

3. An image forming apparatus according to claim 1, wherein the developer regulating member includes an electroconductive portion to which the superimposed voltage is applied, and an insulating portion to be in contact with the developer carrying member.

4. An image forming apparatus according to claim 1, wherein the developer carrying member includes an elastic layer.

5. An image forming apparatus according to claim 1, wherein the developer has a mean degree of circularity of 0.950 or higher.

6. An image forming apparatus according to claim 1, wherein the developer has a mean degree of circularity of 0.970 or higher.

* * * * *